United States Patent [19]

Creus

[11] 4,265,081

[45] May 5, 1981

[54] DRIVEN SPINNING RING DEVICE FOR YARN SPINNING AND TWISTING MACHINES

[75] Inventor: Rufino Creus, Sabadell, Spain

[73] Assignee: Spurmach Espana S. L., Sabadell, Spain

[21] Appl. No.: 895,010

[22] Filed: Apr. 10, 1978

Related U.S. Application Data

[63] Continuation-in-part of Ser. No. 694,998, Jun. 11, 1976, abandoned, which is a continuation-in-part of Ser. No. 663,121, Mar. 2, 1976, Pat. No. 4,114,359.

[30] Foreign Application Priority Data

Mar. 15, 1975 [ES] Spain ..... 435.657
Jun. 4, 1976 [ES] Spain ..... 448.589

[51] Int. Cl.[3] ..... D01H 7/58; D01H 1/241

[52] U.S. Cl. ..... 57/75; 57/78; 57/105; 57/122; 57/124; 57/261

[58] Field of Search ..... 57/119–124, 57/75, 104, 105, 261–263, 78

[56] References Cited

U.S. PATENT DOCUMENTS

| | | | |
|---|---|---|---|
| 2,541,238 | 2/1951 | Goree | 57/124 |
| 2,563,187 | 7/1951 | Pennati | 57/124 |
| 3,543,503 | 12/1970 | Watabe et al. | 57/124 X |
| 3,738,094 | 6/1973 | Costales et al. | 57/124 X |
| 3,785,140 | 1/1974 | Muller | 57/119 X |
| 4,023,342 | 5/1977 | Schenkel | 57/124 X |

FOREIGN PATENT DOCUMENTS 448589 4/1977 Spain .

*Primary Examiner*—John Petrakes
*Attorney, Agent, or Firm*—Brumbaugh, Graves, Donohue & Raymond

[57] ABSTRACT

A yarn spinning and twisting machine which includes a drive transmission from a drive source to a plurality of spinning rings carried by vertically movable platforms and having a control for delaying the starting of the drive transmitted to the spinning rings at the start-up of the machine and for disestablishing the drive to the spinning rings before the end of the last cycle of the machine to maintain the yarn in taut condition and minimize breakage of the yarn.

A drive transmission for the spinning rings of a yarn spinning or twisting machine in which the drive source for the rings is mounted on the main frame of the machine and includes a pair of elongated vertically disposed drive shafts belt driven at the lower ends from the drive source, a pair of longitudinal drive belts extending along the vertically reciprocated platforms which carry the spinning rings, with each belt engaging the elongated vertical shaft and the other end of the belt engaging tensioning and idler rolls carried by the vertically movable platform, belt pulleys for driving selected spinning ring holders from the belt, and belt pulleys for transmitting the drive from one spinning ring to a plurality of others.

A spinning ring, including a split ring for exerting a plurality of different outward forces on upper and lower outer pulleys and generating an outward flow of cooling and cleaning air and providing a protective skirt or lip around the bearing to keep it clean.

17 Claims, 8 Drawing Figures

DRIVEN SPINNING RING DEVICE FOR YARN SPINNING AND TWISTING MACHINES

This application is a continuation-in-part of my copending application, Ser. No. 694,998, filed June 11, 1976, now abandoned, and which, in turn, is a continuation-in-part of my earlier application, Ser. No. 663,121, filed Mar. 2, 1976, now U.S. Pat. No. 4,114,359, issued Sept. 19, 1978.

This invention relates to improvements in continuous spinning or twisting machines in which yarn is taken from a plurality of yarn packages and is twisted and wound on a plurality of tubular spools or bobbins. The twisting and winding of each spool or bobbin is carried out with the help of a traveler supported for movement on a spinning ring in which the traveler is free to travel at high speed on the ring about the axis of the spool or bobbin. More particularly, the present invention relates to improvements in such machines which will permit the twisting and winding operation to be carried out at higher velocity and under controlled conditions which maintain the yarn in taut condition and minimize breakage of the yarn during the starting and stopping of the yarn twisting and winding operation.

The production capacity of such spinning and twisting machines is determined by the linear velocity of the traveler on the ring. The friction of the traveler against the ring produces progressive heating which causes burning of the yarn or thread. It would seem that production capacity could be increased and damage to the yarn minimized by driving the ring in the same direction as the traveler and thereby reduce relative speed between them. Unfortunately, this solution has not worked very well in practice because of the problems in providing a suitable drive transmission for the rings and in providing suitable controls therefor because of the tendency of the yarn to become slack and form curls which increase the danger of breakage on starting and stopping of the machine.

The present invention overcomes these problems and provides for increased production capacity with less breakage by providing a novel drive transmission and a novel control system therefor.

The novel drive transmission provides the means for imparting rotation to an array of rings carried by vertically movable platforms from a drive source mounted on the main frame on the machine. The drive transmission includes elongated vertically disposed drive shafts, belt driven at the ends from the drive source, and longitudinal drive belts, driven at one end from one of the elongated vertical shafts and operatively engaged at the opposite end with an assembly of driven pulleys, idler wheels and belt tension means arranged in a plane and carried by the respective platform. The drive transmission insures that the belt will suitably drive the spinning rings and be maintained under proper tension, notwithstanding the constant change in the angular orientation of the belt as the platform vertically reciprocates.

The novel control system of the present invention enables the machine to be transformed for brief periods of time during starting and stopping of the winding operation into a conventional machine, that is, one provided with stationary rings, so as to avoid the development of yarn slack buildup which tends to cause breakage. By delaying the starting of the drive transmission to the spinning rings at the start-up of the machine and by disestablishing the drive before the end of the last cycle of the machine, the yarn is maintained in taut condition during start-up and stopping and breakage is avoided.

The invention also includes further additional features, namely, a split ring holder capable of exerting a plurality of different outward forces in different bands, for example, on the pulleys mounted thereon, means for generating an outward flow of cooling and cleaning air to prevent excessive buildup of fibers and a protective skirt or lip around the bearing to keep it clean.

These and other features of the invention will be apparent from the detailed description which follows and from the accompanying drawings wherein.

Figure 5:
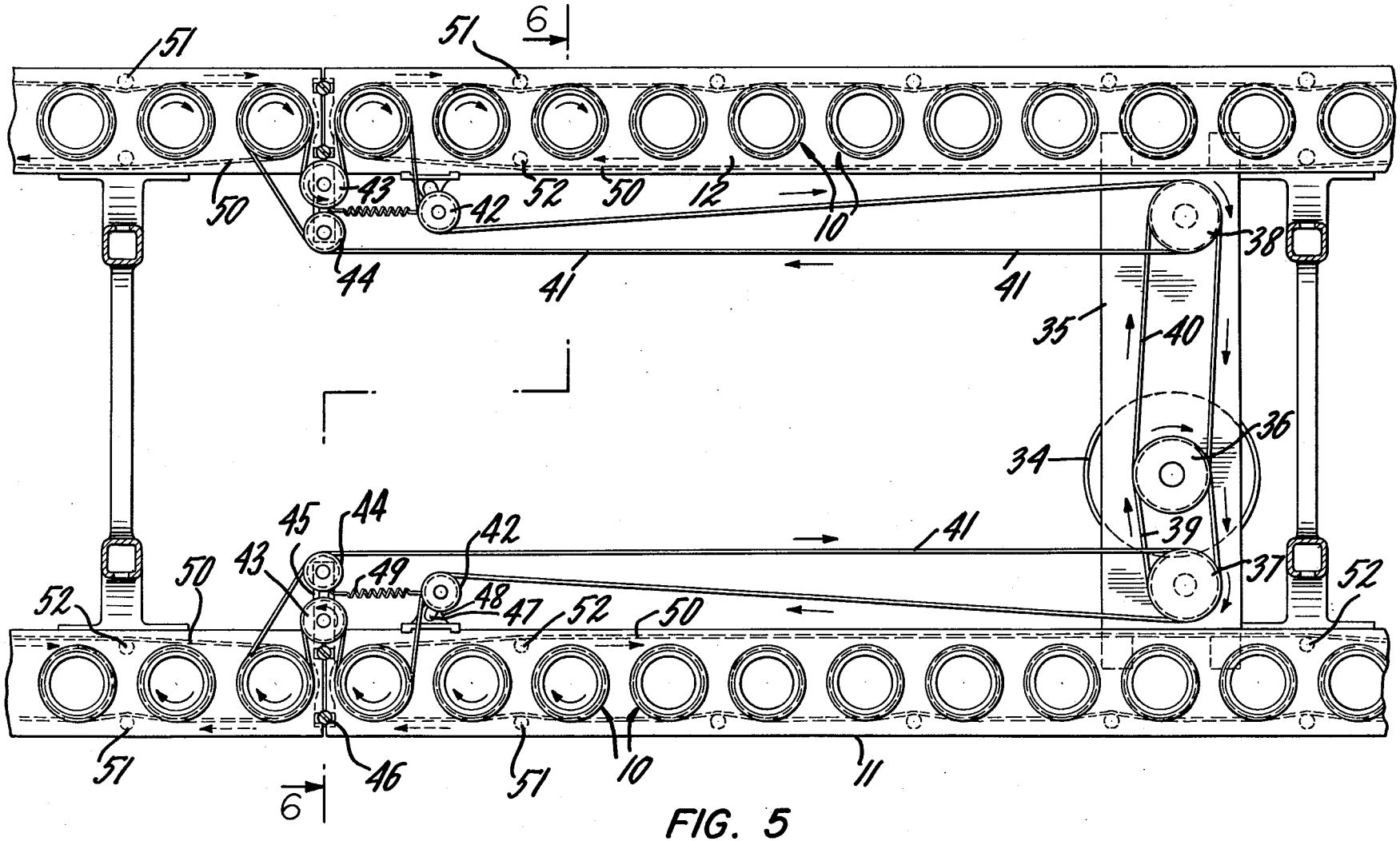
FIG. 5 is a plan view showing the drive transmission system for a plurality of spinning ring devices.
Figure 6:
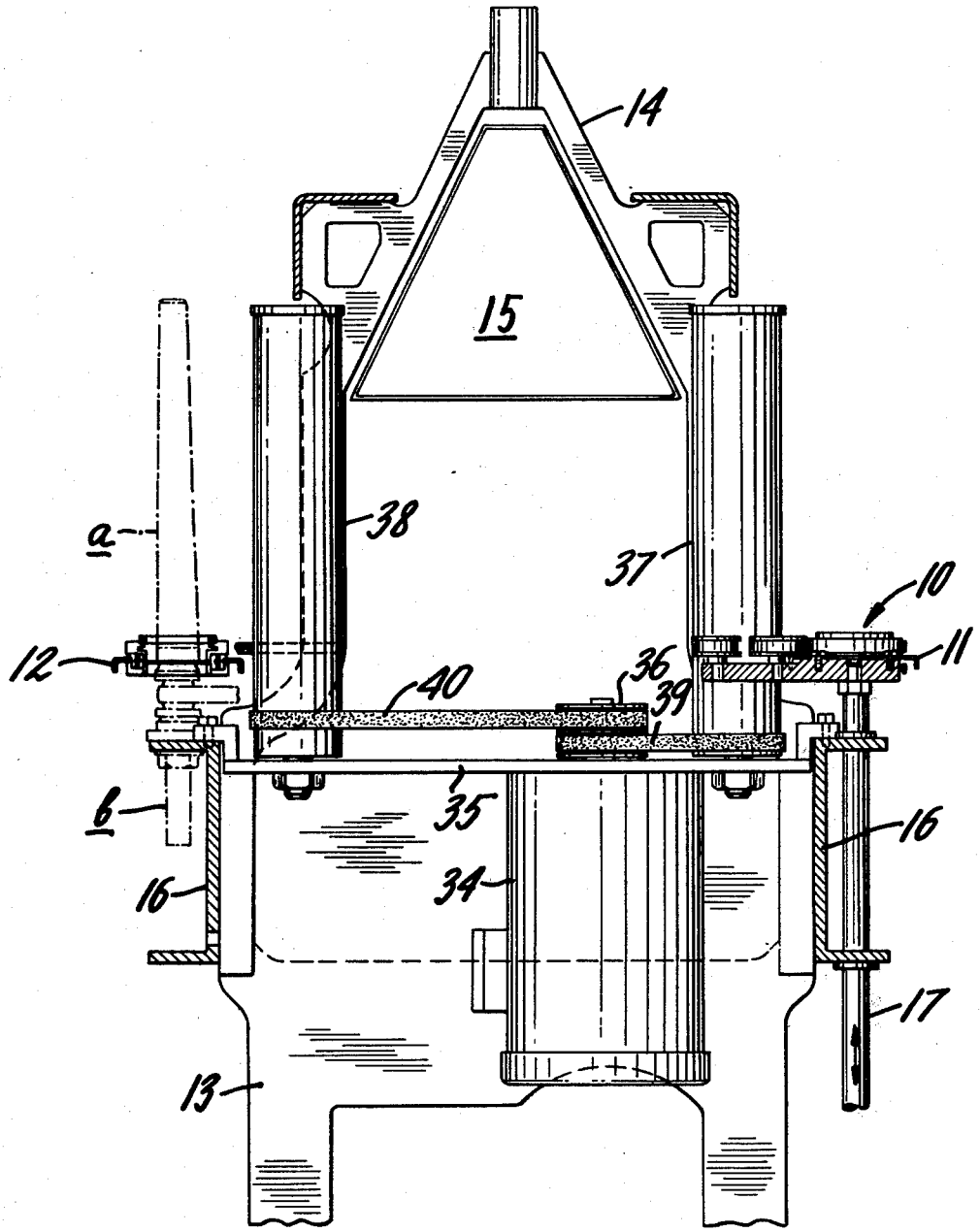
FIG. 6 is a view taken along the line 6—6 of FIG. 5 looking in the direction of the arrows.

A yarn spinning or twisting machine embodying the present invention is best shown in FIGS. 5 and 6 of the drawings in which yarn taken from an overhead package passes through a drafting mechanism (not shown) and is twisted and wound on a tubular bobbin a carried by a rotating spindle b. The yarn is guided around each tube and wound along the axis thereof by a spinning ring device designated by the reference numeral 10.

As shown, the spinning ring devices 10 are spaced apart along two rows, although the number of rows is not important to the invention. The spinning ring devices of one row are mounted along a supporting rail or platform 11, and the spinning ring devices of the other row are mounted along a supporting rail or platform 12. The supporting rails or platforms 11 and 12 are raised and lowered to carry the spinning ring devices upwardly and downwardly in synchronism along the lengths of the tubes a. As the spinning ring devices travel upwardly and downwardly along the axes of the tubes, the yarns are wound around the outer peripheries of the tubes. In actual practice, the platforms reciprocate over small lengths which gradually traverse the length of the tube from one end toward the other.

The yarn spinning or twisting machine includes a main base frame 13, an overhead frame 14 which supports an optional vacuum cleaning head 15 for the collection of fibers and a pair of channel guides 16 which extend horizontally along both sides of the base frame 13. The supporting rails or platforms 11 and 12 are supported at the upper ends of support rods 17 which are guided for vertically reciprocable movement in the channel guides 16. The rails or platforms 11 and 12 are carried so as to displace the spinning rings 10 carried thereby longitudinally along the axes of the respective tubes a and spindles b in order to wind the yarn on the tubes and displace the yarn along the lengths of the tubes.

Figure 1:
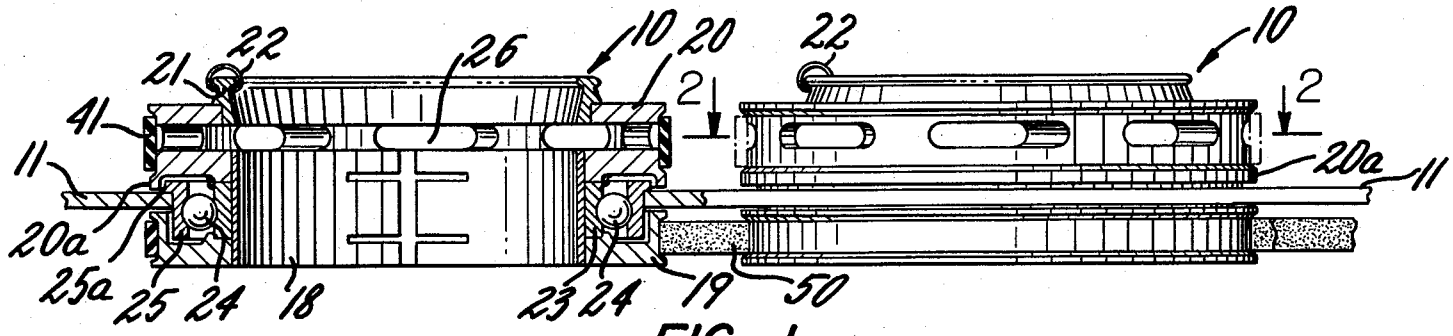
FIG. 1 is an elevational view, partly in cross-section, of a pair of spinning ring devices of the present invention.
Figure 3:
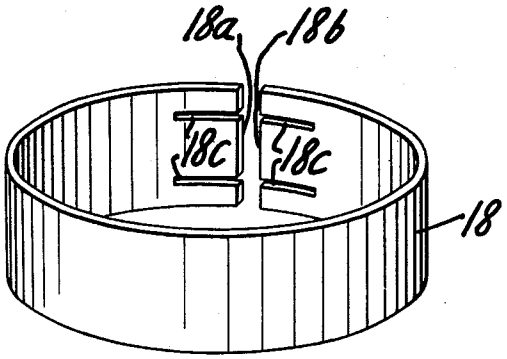
FIG. 3 is a perspective view of a component of the spinning ring device shown in FIG. 1.
Figure 2:
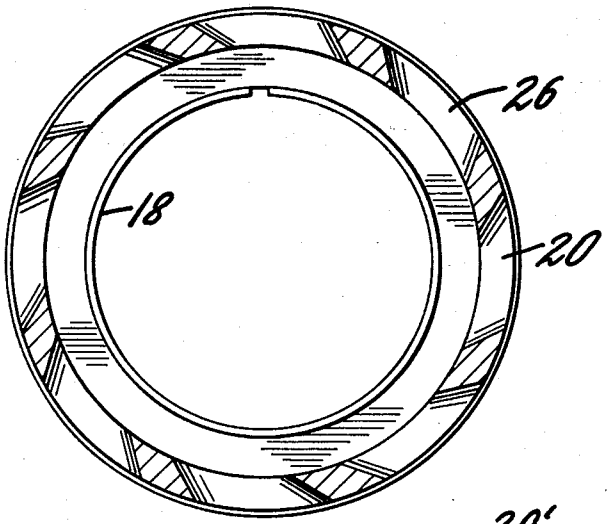
FIG. 2 is a sectional view taken along the line 2—2 of FIG. 1 looking in the direction of the arrows.

The spinning ring devices 10, are best shown in FIGS. 1 through 3, include a spring steel ring holder 18, a lower pulley 19 accommodated on the lower end of the ring holder, an upper pulley 20 accommodated on the upper end of the ring holder, a ring 21 accommodated within the upper end of the upper pulley 20 and a traveler 22 accommodated on the ring 21. As the spindle b rotates at high speed the traveler 22 moves at high speed on the ring 21 around the axis of the spindle to guide the yarn onto the tube as the twist is produced on the yarn. The ring 21 and the ring holder 18 also rotate in the same direction as the traveler 22 to reduce the relative speeds between the traveler and the ring.

Each ring holder is accommodated for rotation in a separate opening formed in the rails or platforms 11 and 12. Toward this end, an inner bearing race 23 encircles the steel band 18 intermediate the lower and upper pulleys 19 and 20, respectively, and a circular array of ball bearings 24 are accommodated between the inner bearing race 23 and an outer bearing race 25. The outer periphery of the outer bearing race 25 is provided with an outer lip or shoulder 25*a* which supports the spinning ring 10 from the upper surface of the respective rail or platform 11, 12.

The upper pulley 20 has a depending lip or skirt 20*a* around the outer, lower region of the pulley 20 to prevent dirt and dust from entering the small space between the lip and the upper surface of the platform or rail to prevent contamination of the bearing.

The steel ring 18 is split, defining spaced apart edges 18 and 18*b*. The edges 18*a* and 18*b*, in turn, are slit at 18*c* to define three separate bands, an upper band, an intermediate band and a lower band. These bands give the ring the capability of exerting three different outward forces, one to exert an outward force to fix the upper pulley 20 thereon, another to exert an outward force to fix the lower pulley 19 thereon and a third to exert an outward force on the inner bearing race 23. The ring 18 thus self-adjusts to facilitate the assembly of these elements and to securely hold them in locked-together condition.

The upper pulley 20 has a plurality of exhaust passages 26 extending outwardly from the center of the spinning ring through the pulley. These passages are defined by walls which define angles with the radial direction so that they generate an outward air flow through the upper pulley for cooling and removal of the fibers.

Figure 4:
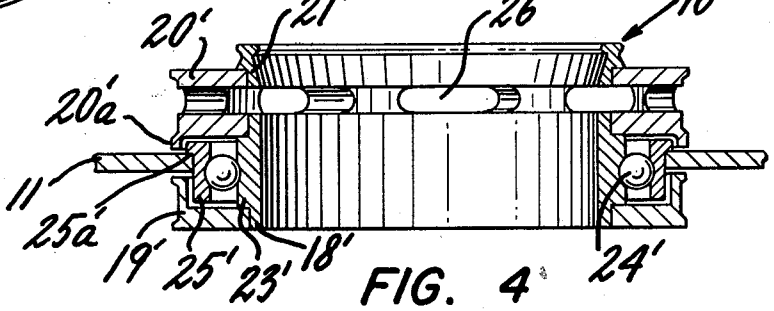
FIG. 4 is a sectional view of an alternate embodiment of the spinning ring device.

A modified spinning ring device is shown in FIG. 4. In this embodiment the spinning ring device includes an internal ring holder 18', a lower pulley 19' supported on the ring holder below the respective rail 11 or 12, an upper pulley 20' supported on the ring holder above the rail 11 or 12 and a supporting ring 21' accommodated within the upper end of the upper pulley 20'. The inner bearing 23' is formed integrally around the outer periphery of the ring 18'. The outer bearing 25' is supported by the engagement of the shoulder 25*a'* with the upper surface of the rail. The inner and outer bearings 23' and 25' are separated by a circular array of ball bearings 24'. Although the inner bearing 23' is shown formed integrally with the ring 18', the inner bearing can be a separate element tightly locked on the ring.

The spinning ring device shown in FIG. 4 is similar to the one shown in FIG. 1 in that the upper pulley 20' is formed with a depending skirt or lip 20*a'* around its lower, outer periphery to keep the bearing free of dust. Also, the upper pulley 20' has an array of passages 26' extending outwardly through the pulley at an angle relative to the radial direction to exhaust air outwardly through the passages of the spinning ring devices.

The drive transmission for the spinning ring devices is best shown in FIGS. 5 and 6 of the drawings. A large number of spinning ring devices along both the vertically movable rails or platforms 11 and 12 is driven from a single electric motor 34. The motor depends from an overhead support 35 which is suspended between the two channel rails 16. The motor 34 drives an upstanding drive pulley 36, and the drive pulley drives the lower ends of a pair of elongated drive shafts 37 and 38 through a pair of belts 39 and 40, respectively. The pair of upstanding, elongated drive shafts 37 and 38 are rotatably mounted at their lower ends in bearings accommodated by the horizontal support 35, and the upper ends of the elongated shafts are approximately the heights of the tubes a to be wound.

The elongated shaft 37 transmits the drive from the motor 34 to the spinning ring devices arranged along the rail or platform 12. More specifically, the elongated shafts 37 and 38 each drivingly engage a longitudinal belt 41. At the other end of the belt span, the belt 41 is guided by a belt engaging assembly of elements arranged in a common plane which includes a pivotally mounted idler roll 42, the upper pulley 20 of one of a group of driven spinning ring devices, an idler roll 43, the upper pulley 20 of another group of driven spinning ring devices, an idler roll 43, the upper pulley 20 of another group of driven spinning ring devices and an idler roll 44. The idler rollers 43 and 44 are mounted on the same rigid arm 45 locked in place by screws 46 to the respective rail or platform. The idler roller 42 is supported on a pivotal arm 47 to a bracket 48 carried by the rail or platform, and the belt 41 is maintained under tension by an elongated spring 49 connecting the pivotal arm 47 and the rigid arm 45. As the rails or platforms travel upwardly and downwardly, the angle of inclination of the belts with the elongated shafts 37, 38 changes, increasing or decreasing the slack to be taken up by the idler 42.

The drive belts 41 transmit the drives from the drive shafts 37 and 38 to adjacent spinning rings on the rails or platforms 11 and 12. Each of these adjacent spinning rings is connected with a separate group of spinning rings having their lower pulleys 19 connected together by separate drive belts 50. Toward this end, the belts 50 run the length of the series of spinning rings, one span being held in contact with the lower pulleys by idler rolls 51 and the opposite span being held out of contact with the lower pulleys by idler rolls 52. As the rails or platforms 11 and 12 travel vertically relative to the frame of the machine to wind the yarn on the tubes a, the belts 41 travel upwardly and downwardly along the lengths of the elongated shafts 37, 38 so that the motor 34 can be maintained in drive transmitting relationship with the spinning rings through the belts 41.

Figure 7:
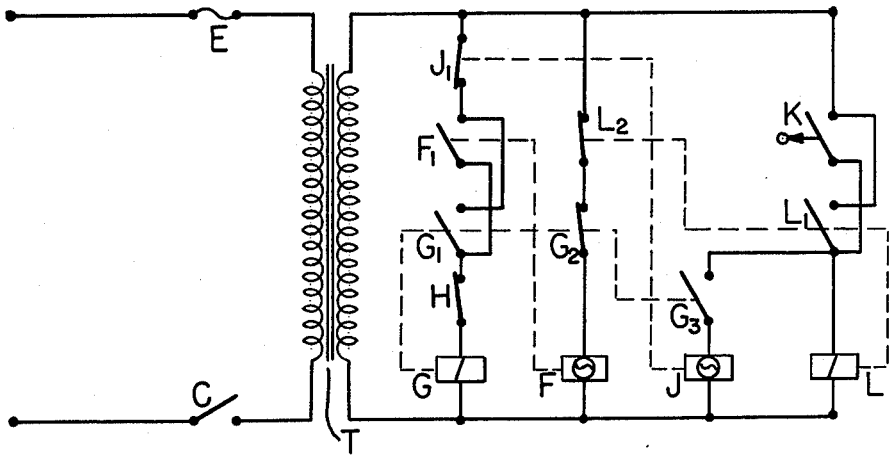
FIGS. 7 and 8 are schematic diagrams of control circuits utilized in the present invention.
Figure 8:
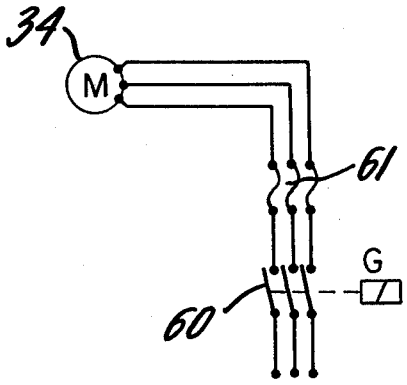

The control circuits illustrated in FIGS. 7 and 8 function to delay the start of the motor 34 and thus the start-up of the rotation of the rings subsequent to the start-up of the winding operation of the machine and to stop the motor 34 and the rotation of the rotating rings prior to the end of the winding operation and the stoppage of the platforms or rails 11 and 12. The delay in the start-up of the drive of the spinning rings occurs after the spindles commence their twisting and winding operations and the platforms or rails begin their vertical motion. During this initial period the rotation of the tubes a produces the twist on the yarn drawn from the packages by the drafting or doubling mechanism (not shown) and the movement imparted to the traveler on the ring is entirely through the turning operation of the spindle, preventing excessive slack from forming in the yarn. At the appropriate time the operation of the motor 34 is initiated and rotation is imparted to the spinning rings through the driven belts 41.

Similarly, when the package wind-up on the tubes is completed, indicating that the rails or platforms 11 and 12 are about to complete their final cycle, the drive transmission to the spinning rings is disestablished so that excessive slack will not be generated during the final cycle of the rails or platforms as they come to rest.

Turning now to a detailed description of the control system with reference to FIGS. 7 and 8, upon closing of the switch C in the primary winding of a transformer T, a circuit is completed through a fuse E, and a stepdown voltage is generated in the secondary winding thereof. Upon closing the switch C, the start timer relay F is energized, and after a predetermined time delay it closes its contact F1, thereby energizing the relay G through the closed thermal relay H, the closed contact F1 and the closed contact J1. The energization of the relay G, in turn, as shown in FIG. 8, closes contacts 60 and completes a circuit through a fuse 61 to the motor 34 thereby starting the motor 34 after the prescribed delay introduced by the time delay relay F. The energization of the relay G also closes the holding contact G1, bypassing the contact F1, to maintain the motor 34 in running condition. Meanwhile, the opening of the contact G2 cuts out the start timer relay F and permits the contact F1 to open. The contact G3 in series with the timer relay J is closed to condition the stop timer relay J for operation.

The solenoid operated switch K is closed by the package of yarn built up on the tube a when the package is complete and the platform or rail 11 or 12 is about to commence its last cycle of operation. When the solenoid operated switch K is closed during the last cycle of the platform or rail, the stop timer relay J is energized, opening the contact J1 and thereby breaking the circuit to the relay G. The breaking of the circuit to the relay G, in turn, opens the contacts 60 and prematurely stops the motor 34 before the platforms or rails 11 and 12 complete their final cycle. During the last cycle of the platforms or rails, they come to rest at or beneath the lower ends of the spindles in the conventional manner so that the operator will have free access to the yarn wound tubes a so that they can be removed from the machine.

When the switch K is closed, indicating that the machine is ready for its final cycle, a circuit is also closed to energize the relay L which, in turn, closes its holding contact L1 and opens the contact L2 in series with the timer relay F so as to disable the start timer F.

The timer relays F and J are adjustable so that the length of the delay in starting the ring drive after the start up of the main drive which imparts rotation to the spindles and the length of the premature disestablishment of the ring drive before the stoppage of the main drive which imparts rotation to the spindles can be controlled.

The invention has been shown in preferred forms and by way of example only, and many modifications and variations are possible within the spirit of the invention. The invention, therefore, is not to be limited to any specified form or embodiment, except insofar as such limitations are set forth in the appended claims.

I claim:

1. A yarn spinning or twisting machine comprising a traveler for guiding yarn in a spinning or twisting operation about a spindle axis, a support ring for the traveler for guiding it in a circular path around the spindle axis under the influence of the yarn, a ring holder rotatably mounted to enable the ring to rotate in the same direction as the traveler to decrease the relative movement between the ring and the traveler, a drive source for imparting a positive drive to the ring holder in the same direction as the traveler, and automatic means for controlling the drive imparted to the ring holder at predetermined points of time during the spinning or twisting operation, said automatic means operating on startup to delay the positive drive imparted to the ring holder until a point of time after the startup of the spinning or twisting operation, and thereafter to impart a positive drive to the ring holder at the end of said delay and to render inoperative the positive drive imparted to the ring holder prior to the discontinuance of the spinning or twisting operation.

2. A yarn spinning or twisting machine as set forth in claim 1 including a platform for a plurality of ring holders, means for imparting relative motion to the platform and a plurality of spinning or twisting axes and in which the automatic means delays the startup of the drive source for the plurality of rings holders in relation to the motion imparted to the platform and for discontinuing the drive source for the plurality of ring holders before the platform comes to rest at the end of the spinning and twisting operation and in which said automatic control means includes sensing means for detecting when a yarn package formed on a spinning or twisting axis is complete and means controlled by said sensing means to initiate the operation of said automatic means for rendering inoperative the drive source for driving the ring holders.

3. A yarn spinning or twisting machine as set forth in claim 2 including a stationary support for said drive source for the driven rings, a driven pulley carried by the movable platform for driving the driven ring holders, an elongated drive shaft mounted for rotation apart from the platform, a drive connection between the drive source and one end of the elongated drive shaft, a belt engageable with the drive shaft and free to travel relative to the axis thereof and belt engaging means carried by the platform including idlers carried in substantially a common plane with said driven pulley, one idler guiding the belt from engagement with the elongated shaft into engagement with the pulley and the other guiding the belt from engagement with the pulley back into engagement with said elongated shaft and spring urged means engaging at least one of said idlers to adjust for slack, particularly during times that the platform is moving and the belt is not transmitting drive to the pulley during the starting and stopping operations.

4. A yarn spinning or twisting machine as set forth in claim 3 including another pulley connected to the driven pulley and driven with the ring and a belt driven by said last mentioned pulley for driving a plurality of other rings carried by the movable platform.

5. A yarn spinning or twisting machine as set forth in claim 4 in which one of said pulleys is accommodated above said platform and the other is accommodated below said platform, bearing means for accommodating the ring holder in the platform and dust prevention means depending from the outer periphery of the lower end of the upper pulley to provide protection for the bearing.

6. A yarn spinning or twisting machine as set forth in claim 1 in which said automatic control means includes adjustable means for controlling the length of the delay in the start-up of the drive source.

7. A yarn spinning or twisting machine as set forth in claim 1 in which said automatic control means includes adjustable means for controlling the length of time between stopping the positive ring drive and the stopping of the spinning and twisting operation.

8. A yarn spinning or twisting machine as set forth in claim 1 including means driven with said ring holder to generate an outward flow of air from said yarn package outwardly through said ring holder outwardly beyond the outer periphery of said ring holder.

9. A yarn spinning or twisting machine comprising a traveler for guiding yarn in a twisting and winding operation about an axis, a support ring for the traveler for guiding it in a circular path around the axis under the influence of the yarn, a split ring holder rotatably mounted to enable the ring to rotate in the same direction as the traveler to decrease the relative movement between the ring and the traveler, a pair of pulleys supported on said split ring holder, the expansive force of said split ring holder locking the upper and lower pulleys thereto and slits formed in the opposite edges of said split ring holder substantially parallel with the upper and lower edges thereof to define different bands so that said split ring holder is capable for exerting different outward forces on the different bands to exert separate lock-ups for the upper and the lower pulleys.

10. A yarn spinning or twisting machine as set forth in claim 9 including an inner bearing race interposed between said upper and lower pulleys and accommodated on said split ring holder and in which said split ring holder includes slits forming three bands for the split ring holder to exert independent outward forces against the upper and lower pulleys and the intermediate inner bearing race.

11. A yarn spinning or twisting machine as set forth in claim 10 including an outer bearing race, a plurality of ball bearings accommodated between the inner and outer bearing races and including a platform for supporing the outer bearing race therein and dust prevention means depending from the outer periphery of the lower end of the upper pulley to provide protection for the bearing.

12. A yarn spinning or twisting machine as set forth in claim 9 including means carried by said split ring holder for generating an outward air flow from said yarn package to prevent build-up of yarn fibers.

13. A yarn spinning or twisting machine comprising a traveler for guiding yarn in a twisting and winding operation about an axis, a support ring for the traveler for guiding it in a circular path around the winding axis under the influence of the yarn, a ring holder rotatably mounted to enable the ring to rotate in the same direction as the traveler to decrease the relative movement between the ring and the traveler, a driven source for driving the ring holder in the same direction as the traveler, a movable platform for carrying a plurality of rings along the axes, a stationary support for the drive source for the driven ring, a driven pulley carried by the movable platform for driving the driven ring, an elongated drive shaft mounted for rotation apart from the platform, a drive connection between the drive source and one end of the elongated drive shaft, an elongated belt engageable with the drive shaft and free to travel relative to the axis thereof and belt engaging means carried by the platform including idlers carried in substantially a common plane with the driven pulley, one idler guiding the belt from engagement with the elongated drive shaft and into engagement with the pulley and the other guiding the belt from engagement with the pulley before it returns to said elongated shaft and spring urged means engaging at least one of said idlers to adjust for slack.

14. A yarn spinning or twisting machine as set forth in claim 13 in which the belt engaging means includes a pair of driven pulleys in said common plane and an idler engaging the belt in passing from one pulley to the other.

15. A yarn spinning or twisting machine comprising a traveler for guiding the yarn in a spinning or twisting operation about a spindle axis, spindle driving means, means for initiating and discontinuing the spindle driving means, a support ring for the traveler for guiding it in a circular path around the spindle axis under the influence of the yarn, a drive source independent of the spindle driving means for driving the ring in the same direction as the traveler, means for initiating the operation of the drive source, delay means for delaying the initiation of the operation of the drive source until after the initiation of the spindle driving means, means for discontinuing the operation of the drive source, means controlled by the initiation of the operation of the drive source for conditioning the means for discontinuing the operation of the drive source and means for triggering the means for discontinuing the operation of the drive source before the discontinuance of the spindle driving means.

16. A yarn spinning or twisting machine as set forth in claim 15, including means controlled by the means for initiating the operation of the drive source for rendering inoperative the delay means and means controlled by the triggering means for reconditioning the delay means.

17. A yarn spinning or twisting method comprising the steps of guiding yarn through a traveler and winding the yarn in a spinning or twisting operation about a spindle axis, the traveler being slidably mounted on a support ring so that it can be guided in a circular path around a spindle axis under the influence of the yarn, imparting a positive drive to the support ring in the same direction as the movement of the traveler under the influence of the yarn, delaying the drive to the support ring until after the initiation of the winding operation and disabling the drive to the support ring prior to the discontinuance of the winding operation.

* * * * *

UNITED STATES PATENT AND TRADEMARK OFFICE

CERTIFICATE OF CORRECTION

PATENT NO. : 4,265,081

DATED : May 5, 1981

INVENTOR(S) : Rufino Creus

It is certified that error appears in the above—identified patent and that said Letters Patent is hereby corrected as shown below:

Col. 7, line 60, "driven" should read --drive--.

Signed and Sealed this

*Fourth* Day of *August 1981*

[SEAL]

*Attest:*

GERALD J. MOSSINGHOFF

*Attesting Officer*

*Commissioner of Patents and Trademarks*